US005511832A

United States Patent [19]

Künzel

[11] Patent Number: 5,511,832

[45] Date of Patent: Apr. 30, 1996

[54] CONTROL BOLT ACTUATING DEVICE

[75] Inventor: Reiner Künzel, Balingen-Frommern, Germany

[73] Assignee: Fritz Fuss GmbH & Co., Albstadt, Germany

[21] Appl. No.: 241,905

[22] Filed: May 12, 1994

[30] Foreign Application Priority Data

May 25, 1993 [DE] Germany ..... 43 17 365.9

[51] Int. Cl.[6] ..... B05C 1/06

[52] U.S. Cl. ..... 292/144; 292/141

[58] Field of Search ..... 292/144, 141, 292/142, 171, 175

[56] References Cited

U.S. PATENT DOCUMENTS

| | | | |
|---|---|---|---|
| 4,913,475 | 4/1990 | Bushnell et al. | 292/144 |
| 4,929,003 | 5/1990 | McConnell | 292/144 |
| 5,029,912 | 7/1991 | Gotanda | 292/144 |
| 5,100,184 | 3/1992 | Schmitt | 292/144 |
| 5,199,288 | 4/1993 | Meriläinen et al. | 292/144 |
| 5,249,831 | 10/1993 | Maniaci | 292/144 |

FOREIGN PATENT DOCUMENTS

| | | |
|---|---|---|
| 2659470 | 5/1979 | Germany . |
| 3631043 | 3/1988 | Germany . |

*Primary Examiner*—Steven N. Meyers
*Assistant Examiner*—Monica E. Millner
*Attorney, Agent, or Firm*—Keck, Mahin & Cate

[57] ABSTRACT

A bolt actuating device controlled by a switching device of a burglar alarm is described. The adjusting device has a direct current motor with clockwise-counterclockwise operation and whose rotation direction is controllable by polarity reversal. The bolt is oriented transversely to the motor shaft. The motor rotation is transformed into a longitudinal movement by means of a gear and is transferred by means of a flexible shaft or a bent lever to the bolt.

10 Claims, 3 Drawing Sheets

CONTROL BOLT ACTUATING DEVICE

BACKGROUND OF THE INVENTION

The invention relates to a bolt actuating device with a locking unit having a lock bolt and an electric adjusting device, the adjusting device having a direct current electric motor with anticlockwise-clockwise rotation, whose rotation direction is controllable by polarity reversal and in which there is a gear for transforming the motor rotation into a longitudinal movement along the motor rotation axis.

Such bolt actuating or operating devices are used, in conjunction with a burglar alarm, to prevent the opening of a door, if the alarm is activated or armed. Only if the alarm is in the inactivated or unarmed state, is it possible to slide back the bolt and therefore open the door. It is known to actuate the lock bolt with a mechanical key lock. Actuations with the aid of electromagnets are also known, in which one electromagnet is required for opening and another electromagnet for closing the bolt.

DE 36 31 043 C1 discloses a device of the present type, particularly for motor vehicle door locks, which has a reversible electric motor, which drives, by means of a clutch, a spindle drive for the bolt. As a result of its dimensions and construction, such a device is not suitable for fitting in a standard door or door frame of a building.

SUMMARY OF THE INVENTION

The object of the invention is to provide a bolt actuating device of the aforementioned type, which operates in a particularly secure and reliable manner and which can be installed in a standard door or door frame.

This object is achieved in that the bolt is oriented transversely to the motor shaft and there is a flexible shaft or a bent lever between the gear and the bolt, with which the longitudinal movement can be transformed into a transverse movement.

The invention has the advantage that the individual components can have small geometrical dimensions and are therefore suitable for installation in all standard door frames and panels. In conjunction with an alarm there is no need to have an all-round surface protection and/or complicated electronics for sabotage monitoring in connection with an adjusting device, because the separate control element is responsible for activation/deactivation.

According to a preferred further development of the invention, the gear has a spindle drive, which is driven by the shaft of an electric motor, the spindle drive acts on one end of the flexible shaft and the other end is fixed to the bolt. This leads to a forcibly guided reversal of the longitudinal movement into a bolt transverse movement.

In another advantageous further development there are casing-fixed guidance means, preferably spaced bolts or pins, which facilitate the reversal of the flexible shaft.

Alernatively a forcibly guided reversal or transformation of the longitudinal movement into a bolt transverse movement is achieved in that the spindle drive acts on two lever arms interconnected in articulated manner, one of the lever arms being fixed and the other being articulated to the bolt (bent lever).

According to a preferred further development there are also means for the mechanical emergency unlocking in the case of danger or a power failure or operating failure of the adjusting device, so that in an emergency the bolt can be unlocked with the aid of a tool.

It is particularly advantageous for the bolt to have a longitudinal groove for receiving the flexible shaft, if the bolt is located in a bolt guide.

In order to prevent an unauthorized person gaining access by sliding back the bolt by force, it is advantageous for there to be a releasable, mechanical blocking device for the bolt in its extended position.

It is particularly simple and reliable for the blocking device to be controlled by the spindle drive. The movement of the spindle drive on actuating the bolt is simultaneously utilized for operating the blocking device. In preferred manner, this takes place in that the blocking device has a blocking pin, which is moved by a slide displaceable on the spindle.

The emergency unlocking can be ensured in simple manner in that the motor and the gear are combined as a unit, e.g. on a mounting plate, that for emergency unlocking purposes said unit is displaceably located in a casing so as to be movable away from the bolt and in the direction of the motor shaft, that the bolt is separately displaceably placed in the casing and that there is a holding device, which detachably holds the unit in an operating position.

Advantageously the holding device is a spring, which is supported on the casing.

In conjunction with the emergency unlocking, an advantageous further development consists of providing a cam lever, operable from the outside, for displacing the unit formed by the motor, the gear and optionally the mounting plate.

It is particularly appropriate for the lock bolt to have a round cross-section and to have on the door or door frame side a correspondingly round bush for receiving the lock bolt. The round cross-section has the advantage that the bush can easily be installed with a conventional drilling tool. The cross-section can be both circular and oval.

Operating reliability is further increased by providing a current and/or torque monitoring means for providing protection against the jamming of the electric motor.

Another advantageous development of the invention consists of providing on the switching device side a coding device and on the adjusting device side a decoding device, together with an evaluating circuit and that a motor control only takes place if a code given in the switching position is present on the electric motor.

Thus, only in the case of coincidence between the code at the alarm station on the one hand and at the adjusting device on the other is current supplied to the direct current motor, otherwise the adjusting device is not activated.

It is advantageous for coding to take place by means of an electric signal superimposed on the motor supply voltage. In this way there is no need for separate transmission paths for the coding.

It is also advantageous for there to be position sensors for determining the end position of the lock bolt.

BRIEF DESCRIPTION OF THE DRAWINGS

The invention is described in greater detail hereinafter relative to two embodiments and the attached drawings, wherein show.

DETAILED DESCRIPTION OF THE EMBODIMENTS

Figure 1:
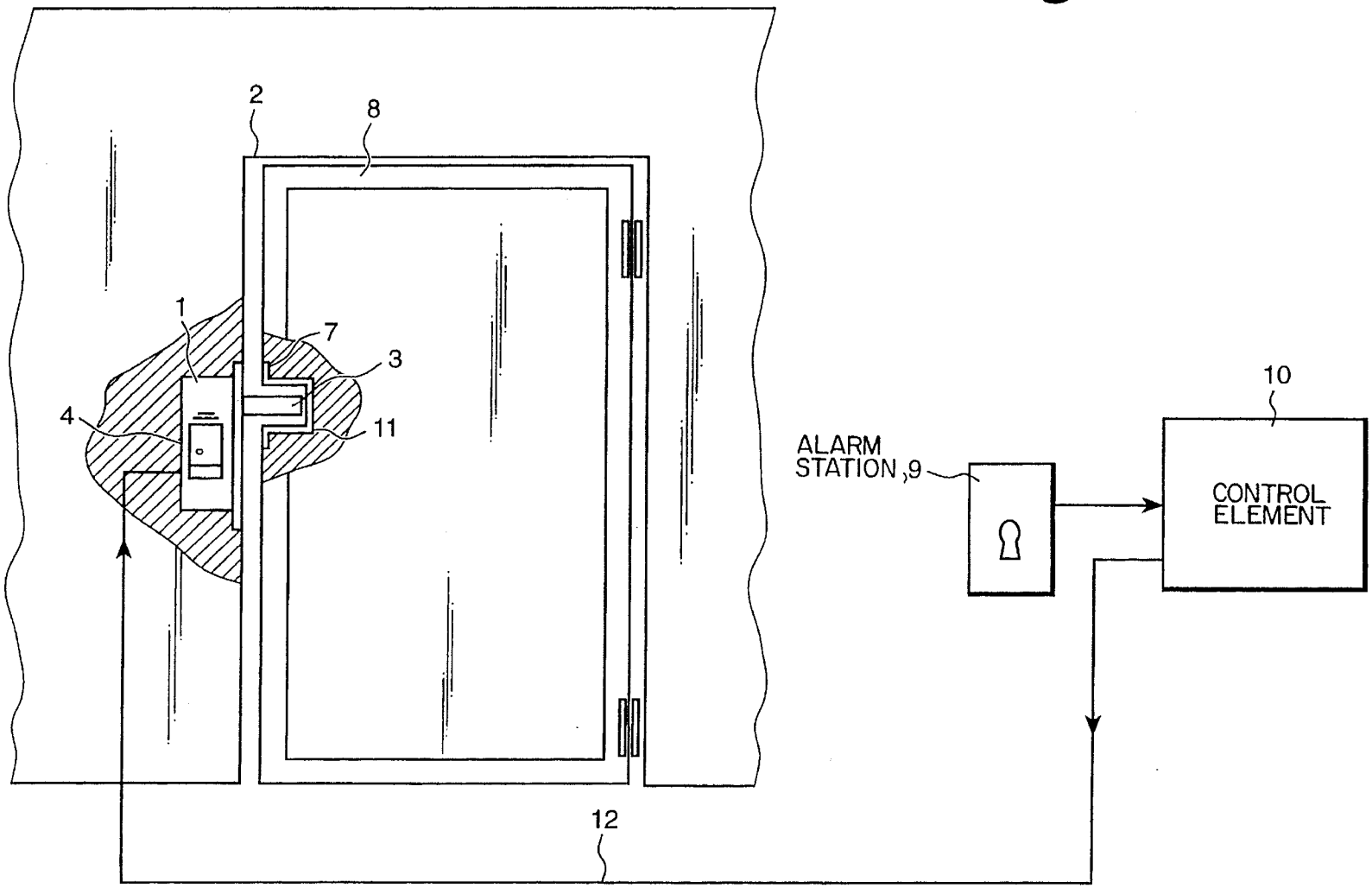
FIG. 1 Diagrammatically a door with a bolt actuating device in conjunction with an alarm station.

In FIG. 11 is an adjusting device for a lock bolt 3, which is installed in a door frame 2. The associated parts are shown in partial cross-section in the drawing. A bush 11 with a flange 7 for receiving the lock bolt 3 is installed in flush manner in a door panel 8 and in the extended locking or end position shown in FIG. 1 it is located in the bush 11.

The lock bolt 3 is driven by a direct current electric motor 4, which is controlled by means of a line 12 from an alarm station 10 of a burglar alarm. The activation or deactivation of the alarm takes place with the aid of a separate control element 9, which is located outside the area protected by the alarm.

If the alarm constraint condition is fulfilled, activation of the alarm can take place from the control element 9. When the activation is detected by the alarm station 10, then the electric motor 4 in the adjusting device 1 is supplied with power from the alarm station 10 and extended into the represented end position, so that the door panel 8 is locked. It is only possible to open the door if beforehand the alarm on the control element 9 has been deactivated.

Figure 2:
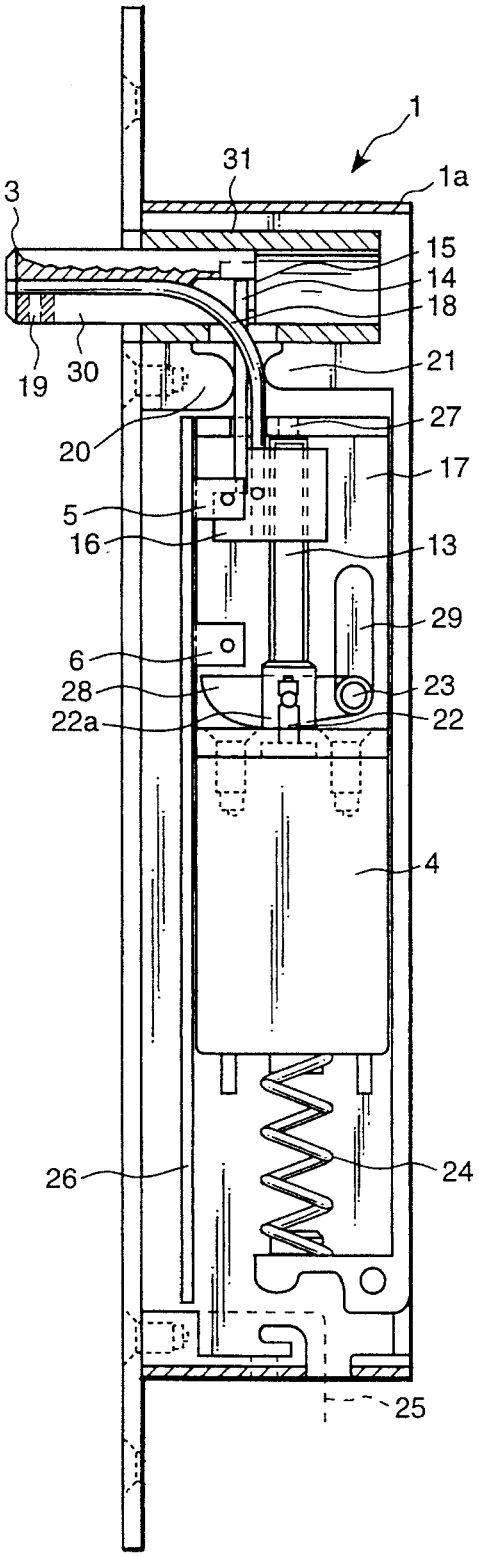
FIGS. 2 to 4 Diagrammatically a cross-section through an adjusting device for the bolt actuating device according to FIG. 1 in three different operating states.

According to FIG. 2 the adjusting device 1 has a casing 1*a*, which in the represented embodiment comprises a zinc pressure die casting and can be fitted in a frame 2. The lock bolt 3 here has a circular cross-section. FIG. 2 shows the lock bolt in the inserted state. The electric motor 4 is fixed to a mounting plate 17, which is fitted in the interior of the adjusting device 1. The electric motor 4 has a shaft 22, which is connected by means of a gear to the lock bolt 3, through which the rotary movement is transformed into a bolt transverse movement.

For this purpose the motor shaft 22 is connected by means of a clutch 22*a* to a spindle 13. The other end of the spindle 13 is mounted in a guide bush 27. On the spindle 13 is located a guide piece 16 for receiving one end of a flexible shaft 18. The guide piece 16 is a slide having an internal thread. The spindle drive, formed by the spindle 13 and the guide piece 16, transforms the rotary movement of the electric motor 4 into a translatory movement of the guide piece and the flexible shaft 18 fitted thereto. As a result the guide piece 16 is guided in a guide, which can e.g. have a mechanical stop. If the guide piece 16 is in the end position with the lock bolt 3 extended, then the lock bolt 3 cannot be introduced by force. The other end of the flexible shaft 18 is fitted to a clamp piece 19, which is connected to the lock bolt 3.

There are guide elements 20, 21 for guiding the flexible shaft 18. In the simplest case they can be round bolts, which are vertically displaced and fixed to the left and right on the casing 1*a* and in this way form a guide for the flexible shaft 18. There is a printed circuit board 26, which e.g. has electronic components for controlling the electric motor 4. For the electrical connection of the electronic components there is a lead 25, which is introduced through the casing bottom.

In the embodiment shown in FIG. 2 the overall arrangement comprising the motor 4, the mounting plate 17, the shaft 22, the spindle 13 and the guide piece 16 with the guide bush 27 is installed in vertically movable manner. In the normal state this arrangement is vertically locked and immovable. For an emergency unlocking, e.g. in the case of a power or operating failure, then the device 1 can be mechanically unlocked by means of a special tool. For this purpose there is on the outer casing 1*a* a bore or recess 23, into which can be externally introduced a special tool. On actuating the emergency unlocking system the complete motor reception system constituted by the mounting plate 17, shaft 22, etc. is pressed against a spring 24, positioned between the base plate of the casing 1*a* and the motor 4 and in this way the lock bolt 3 is inserted.

The flexible shaft 18 can be both compressively and tensile stressed. By means of the spindle drive 13, 16 the flexible shaft 18 is moved in the direction of the spindle 13 or the coaxial motor shaft 22. As the flexible shaft is on the one hand fixed to the lock bolt 3 and on the other is turned by 90° by means of the guide elements 20, 21, the longitudinal movement of the guide piece 16 is transformed into a transverse movement of the lock bolt 3. As a function of the rotation direction of the motor 4 in this way the lock bolt brings about a locking or unlocking of the device. In the case of an upward movement of the guide piece 16 the flexible shaft 18 is subject to pressure action and slides the lock bolt outwards. In the case of a downward movement of the guide piece 16 the flexible shaft 18 is subject to tension and moves the lock bolt 3 inwards.

The flexible shaft can be made from any flexible material, e.g. circular Nylon material, circular spring steel or flat spring steel. It is also possible to use other materials having similar characteristics, such as e.g. a flexible Wire with a corresponding stiffness and flexibility.

The two end positions of the lock bolt 3 are monitored by position sensors 5, 6, which are interrogated and evaluated from the alarm station 10. These position sensors 5, 6 can e.g. be contactless operating bifurcated or reflection light barriers or capacitive or inductive proximity switches.

The two end positions of the guide piece 16 or the lock bolt 3 (FIG. 5) are monitored by position sensors 5, 6, which are interrogated and evaluated from the alarm station 10.

A monitoring unit 64 (FIG. 5) e.g. evaluates by means of a torque or current monitoring system the operation of the motor, in order to e.g. protect the latter against jamming. There is also a decoding device 65 (FIG. 5), which decodes and assesses decoded signals from the alarm station 10. Only if a permitted code is transmitted, is power supplied to the d.c. motor 4. A clockwise or counterclockwise rotation of the motor 4 and therefore opposite bolt movements are achieved by applying different polarity for the power supply.

As is illustrated by the part sectional view of the bolt 3, the latter has on its side facing the spindle drive 13, 16 a longitudinal groove 30. Longitudinal groove 30 receives the flexible shaft 18 within a bolt guide 31. The shape of the bolt guide 31 can therefore correspond to the outer contour of the bolt 3.

If the bolt 3 is in the end position, then it is secured against sliding back by a blocking device controlled by the spindle drive 13, 16. A blocking pin 14 fixed to the guide piece 16 moves together with the guide piece 16 behind the bolt 3 or into a recess 15 in the bolt 3. The blocking action is cancelled out in the case of a reverse movement of the spindle drive 13, 16.

Figure 3:
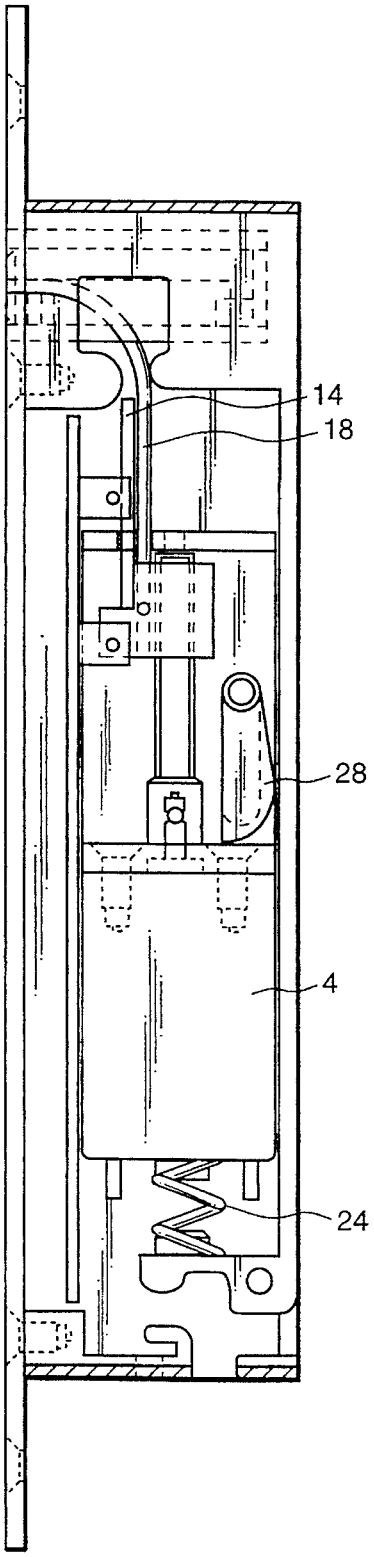

FIG. 3 shows an emergency unlocking means, in which the mounting plate 17, together with the components located thereon, is moved downwards by means of a cam lever 28 out of the operating position shown in FIG. 2. As this automatically releases the blocking device 14, 15 for the bolt, the flexible shaft draws it back into the casing 1*a*. Access to the cam lever 28 takes place by means of the recess 23, so that the spindle drive 13, 16 is not operated. In the emergency unlocking state the cam lever 28 is placed in spreading manner in front of the mounting plate 17 and in this way prevents it from being forced back by the spring 24 into the operating and locked position of the bolt 3.

Figure 4:
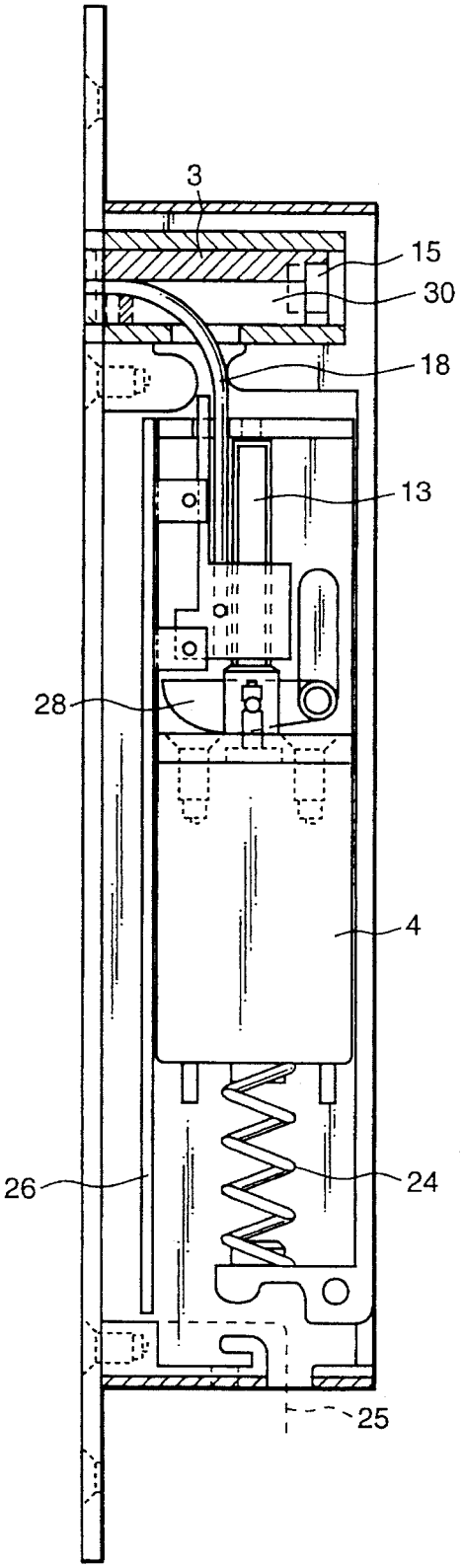

FIG. 4 shows the bolt 3 in its retracted position, in which it has been brought into the standard operating mode by actuating the motor 4 and the spindle drive 13, 16.

Figure 5:
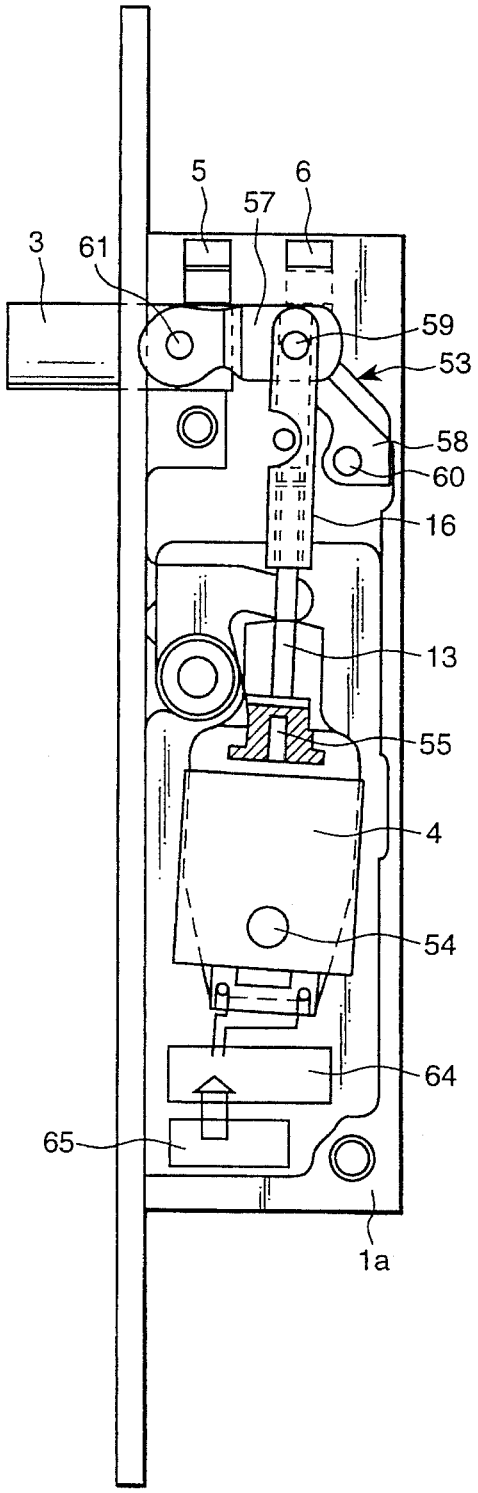
FIG. 5 Diagrammatically a cross-section through another adjusting device.

In FIG. 5 the same parts as in FIGS. 2 to 4 are given the same reference numerals. In the embodiment according to FIG. 5 the electric motor 4 is pivotably mounted on a stud 54, which is perpendicular to the motor shaft 55. The motor shaft 55 is connected to a spindle drive 13, 16. Between the spindle drive 13, 16 and the lock bolt 3 is provided a bent lever 53, comprising two lever arm 57, 58 connected in an articulated manner and to whose connecting joint 59 is articulated the guide piece 16. The two lever arms 57, 58 are articulated by means of studs 60, 61 on the casing 1*a* or on the lock bolt 3, the studs 60, 61 running parallel to the axis of the connecting joint 59 and to the stud 54 on the electric motor 4.

By means of the spindle drive 13, 16 the connecting joint 59 is moved in the direction of the spindle 13 or the coaxial motor shaft 55. As the spindle 13 or the motor shaft 55 is at an angle to the imaginary connecting line between the two studs 60, 61 of the lever arms 57, 58, the two lever arms 57, 58 bring about a longitudinal displacement of the lock bolt 3.

It is finally to be understood that although preferred embodiments of the present invention have been described, various other embodiments and variations may occur to those skilled in the art which fall within the scope and spirit of the invention, and such other embodiments and variations are intended to be covered by the following claims.

What we claim is:

1. A bolt actuating device with a locking unit having a lock bolt and an electric adjusting device, the adjusting device having a direct current electric motor with anticlockwise-clockwise rotation, whose rotation direction is controllable by polarity reversal and in which there is a guide member moveable relative to a gear for transforming the motor rotation into a longitudinal movement along a motor rotation axis, wherein the bolt is oriented transversely to a motor shaft and there is a flexible shaft between the gear and the bolt, with which the longitudinal movement can be transformed into a transverse movement.

2. A bolt actuating device according to claim 1, wherein the gear has a spindle drive driven by the motor shaft and wherein the flexible shaft on one end is connected to the spindle drive and on the other end is connected to the bolt.

3. A bolt actuating device according to claim 1, wherein the bolt has a longitudinal groove for receiving the flexible shaft when the bolt is located in a bolt guide.

4. A bolt actuating device according to claim 1, wherein there is a casing-fixed reversal means for the flexible shaft.

5. A bolt actuating device according to claim 1, wherein there is a detachable, mechanical blocking device for the bolt in its extended position.

6. A bolt actuating device according to claim 5, wherein the blocking device is controlled by the spindle drive.

7. A bolt actuating device according to claim 5, wherein the blocking device has a blocking pin, which is moved by a slide displaceable on a spindle.

8. A bolt actuating device with a locking unit having a lock bolt and an electric adjusting device, the adjusting device having a direct current electric motor with anticlockwise-clockwise rotation, whose rotation direction is controllable by polarity reversal and in which there is a guide member moveable relative to a gear for transforming the motor rotation into a longitudinal movement along a motor rotation axis, wherein the bolt is oriented transversely to a motor shaft and there is a flexible shaft between the gear and the bolt, with which the longitudinal movement can be transformed into a transverse movement, wherein the motor and the gear are located on a mounting plate, wherein for emergency unlocking the mounting plate is placed in a motor reception system so as to be displaceable away from the bolt and in the direction of the motor shaft, wherein the bolt is separately displaceably located in the casing and wherein a holding device is provided, which detachably holds in an operating position the motor, the gear and the mounting plate.

9. A bolt actuating device according to claim 8, wherein the holding device is a spring, which is supported on the casing.

10. A bolt actuating device according to claim 8, wherein there is a cam lever operable from the outside for the displacement of the motor, the gear and the mounting plate.

* * * * *